US008747107B2

(12) United States Patent
Mok

(10) Patent No.: US 8,747,107 B2
(45) Date of Patent: Jun. 10, 2014

(54) GAS LIGHTER WITH SAFETY MECHANISM

(75) Inventor: Ka Wai Mok, Hong Kong (HK)

(73) Assignee: Tien Sung Electric Company Limited, Hong Kong (HK)

( * ) Notice: Subject to any disclaimer, the term of this patent is extended or adjusted under 35 U.S.C. 154(b) by 685 days.

(21) Appl. No.: 13/008,492

(22) Filed: Jan. 18, 2011

(65) Prior Publication Data

US 2012/0183912 A1 Jul. 19, 2012

(51) Int. Cl.
*F23Q 1/02* (2006.01)

(52) U.S. Cl.
USPC ..... 431/274; 431/267; 431/273; 431/275; 431/276; 431/277; 131/185; 131/234; 131/351

(58) Field of Classification Search
USPC ..... 431/153, 273, 274, 275, 276, 277; 131/185, 234, 351
See application file for complete search history.

(56) References Cited

U.S. PATENT DOCUMENTS

| | | | | | |
|---|---|---|---|---|---|
| 3,063,276 | A * | 11/1962 | Cassan | 431/254 |
| 3,414,364 | A * | 12/1968 | Bert | 431/143 |
| 5,066,220 | A * | 11/1991 | Vick | 431/277 |
| 5,509,799 | A * | 4/1996 | Sher | 431/276 |
| 5,538,419 | A * | 7/1996 | Lin | 431/253 |
| 5,634,787 | A * | 6/1997 | Frigiere | 431/153 |
| 5,676,537 | A * | 10/1997 | Fang | 431/153 |
| 5,788,474 | A * | 8/1998 | Chung et al. | 431/153 |
| 5,971,748 | A * | 10/1999 | Rogelet | 431/153 |
| 6,053,727 | A * | 4/2000 | Potskhishvili et al. | 431/153 |
| 6,095,795 | A * | 8/2000 | Potskhishvili et al. | 431/153 |
| 6,099,296 | A * | 8/2000 | Wang | 431/153 |
| 6,099,298 | A * | 8/2000 | Potskhishvili et al. | 431/153 |
| 6,431,854 | B1 * | 8/2002 | Fang | 431/153 |
| 6,612,831 | B1 * | 9/2003 | Ansquer et al. | 431/153 |
| 6,764,300 | B2 * | 7/2004 | Sewalt | 431/153 |
| 6,786,715 | B1 * | 9/2004 | Saito | 431/153 |
| 8,241,033 | B2 * | 8/2012 | Shimizu | 431/153 |
| 2003/0031968 | A1 * | 2/2003 | Sewalt | 431/153 |
| 2005/0118547 | A1 * | 6/2005 | Li | 431/254 |
| 2006/0035185 | A1 * | 2/2006 | Chan et al. | 431/153 |
| 2007/0172782 | A1 * | 7/2007 | Weicheng | 431/153 |
| 2009/0029301 | A1 * | 1/2009 | Shimizu | 431/153 |
| 2009/0246721 | A1 * | 10/2009 | Wu | 431/276 |
| 2011/0097675 | A1 * | 4/2011 | Deng | 431/12 |

FOREIGN PATENT DOCUMENTS

EP 1106926 A2 * 6/2001

* cited by examiner

*Primary Examiner* — Jorge Pereiro
(74) *Attorney, Agent, or Firm* — Sughrue Mion, PLLC

(57) ABSTRACT

A gas lighter with safety mechanism comprising an inner frame mounted on top of a fuel reservoir and provided with a valve for releasing fuel contained in the fuel reservoir; an outer frame mounted on top of the inner frame and having two supports each of which is provided with a L-shaped supporting hole including a vertical section and a horizontal section; a lever sandwiched between the two supports and pivotable with respect to the outer frame to actuate the valve; a flint disposed between the two supports; a friction wheel rotatably sleeved on a shaft between the two supports, the shaft are movably supported in the supporting holes, the friction wheel is separate from the flint when the shaft is moved to the vertical sections while contacts the flint to enable to generate sparks by rotating the friction wheel when the shaft is moved to the horizontal sections.

8 Claims, 3 Drawing Sheets

GAS LIGHTER WITH SAFETY MECHANISM

FIELD OF THE INVENTION

The present invention relates to the field of gas lighters, and more particularly to gas lighters with safety mechanism to enable to prevent users from igniting the lighters unintentionally, and particularly to prevent children from igniting the lighters.

BACKGROUND OF THE INVENTION

A conventional gas lighter generally comprises a fuel reservoir for containing combustible fuel, a valve for releasing the combustible fuel from the fuel reservoir, a lever for activating the valve, and a flint and a friction wheel for generating sparks toward the valve by virtue of friction therebetween. The sparks could thereby light the combustible fuel released from fuel reservoir through the valve, and then generate flame.

Such gas lighters are very convenient for use, and it is easy to generate flame, even for children. Thus, it is dangerous when users ignite the lighters unintentionally, and is even more dangerous when children manage to ignite the lighters intentionally.

Many safety lighters with safety devices have been developed. However, the safety devices in the existing safety lighters are either complex, which prevent not only children but also adults from igniting the lighters, or very simple, which are not sufficient to prevent children from operating the lighters.

Therefore, it is desired to provide a gas lighter with safety mechanism, which is simple in its structure but sufficient to avoid unintentional operation of the lighter by adults and intentional operation of the lighter by children.

SUMMARY OF THE INVENTION

The object of the present invention is to provide a gas lighter to prevent users from igniting the lighters unintentionally, and particularly to prevent children from igniting the lighters.

To achieve the above object, the present invention provides a gas lighter with safety mechanism which may comprises an inner frame mounted on top of a fuel reservoir containing combustible fuel and provided with a valve for releasing the fuel contained in the fuel reservoir; an outer frame mounted on top of the inner frame and having two supports separately extended upwards from opposite sides of the outer frame and aligned with each other, in which each of the supports is provided with a L-shaped supporting hole including a vertical section and a horizontal section, and the vertical section is nearer to the valve than the horizontal section; a lever sandwiched between the two supports and pivotable with respect to the outer frame to actuate the valve; a flint disposed between the two supports, in which the flint is aligned with the horizontal sections of the L-shaped supporting holes and biased from the vertical sections thereof; a friction wheel rotatably sleeved on a shaft between the two supports, in which opposite ends of the shaft are movably supported in the L-shaped supporting holes of the supports, the friction wheel is separate from the flint when the shaft is moved to the vertical sections of the L-shaped supporting holes, while the friction wheel contacts the flint to enable to generate sparks by rotating the friction wheel when the shaft is moved to the horizontal sections of the L-shaped supporting holes.

As the friction wheel selectively contacts the flint rather than always contacts the latter, sparks could only be generated when the friction wheel is intentionally brought to contact the flint. Therefore, common users would not ignite the gas lighters of the present invention unintentionally, while children would be difficult to ignite the gas lighters, or even not know how to operate the gas lighters.

Preferably, a first spring may be mounted between an end of the lever opposite to the valve and the outer frame, which always pushes the lever upwards against the friction wheel and in turn always pushes the shaft to the vertical sections of the L-shaped supporting holes.

Preferably, a screw thread is formed at each end of the shaft and a matching screw thread is formed at a top part of the vertical section of each L-shaped supporting hole, the screw thread and matching screw thread engage with each other when the opposite ends of the shaft are pushed upwards against the top of the vertical sections.

Furthermore, the friction wheel comprises an inner bore extending through the whole length thereof, and a first and second side wheels are provided to sandwich the friction wheel, in which the first side wheel includes a first rim adjoining one end of the friction wheel, a first protrusion extending from the first rim into the inner bore, a first axle aperture formed at tip of the first protrusion, a second axle aperture formed at bottom of the first rim and a through hole communicating the first and second axle apertures, in which the diameter of the first axle aperture is slightly larger than that of the shaft to enable to be rotatably mounted on the latter. The second side wheel includes a second rim adjoining the other end of the friction wheel, a second protrusion extending from the second rim into the inner bore, a third axle aperture formed at tip of the second protrusion, and a fourth axle aperture formed at bottom of the second rim, in which the fourth axle aperture has a diameter slightly larger than that of the shaft and communicates with the third axle aperture. And the gas lighter further comprises: a first flange formed on the shaft the size of which is slightly smaller than that of the second axle aperture to be movable back and forth in the latter; a first compression spring mounted within the through hole between the first side wheel and the first flange to press the first rim against the end of the friction wheel; a stopper mounted in the inner bore in front of the second protrusion and fixed to the shaft; and a second compression spring mounted within the third axle aperture between the second side wheel and the stopper.

Preferably, a flint seat may be provided to receive the flint, in which the flint seat is received in a receiver of the inner frame and extends out of the receiver through a hole; a second spring is located between the second flange and the receiver intending to push the flint seat out of the receiver; the flint seat is provided with a second flange at a bottom thereof the size of which is larger than that of the hole to prevent the flint seat from getting rid of the receiver through the hole, and a recess at top of the flint seat for receiving a third spring and the flint consequently; the third spring intends to push the flint upward towards the friction wheel.

BRIEF DESCRIPTION OF THE DRAWINGS

The present invention will be described in detail with reference to the accompanying drawings. The figures are for illustration purposes only and should not be construed as limitation to the protective scope of the present invention, in which.

DETAILED DESCRIPTION OF THE INVENTION

The technical features, objects and effects of the present invention will be better understood by the skilled in this art from the detailed description of the preferred embodiments of the present invention in conjunction with the accompanying drawings. Exemplary embodiments of the present application and the description thereof are for illustration purpose only, and should not be construed as limitation to the protective scope of the present invention.

Figure 1:
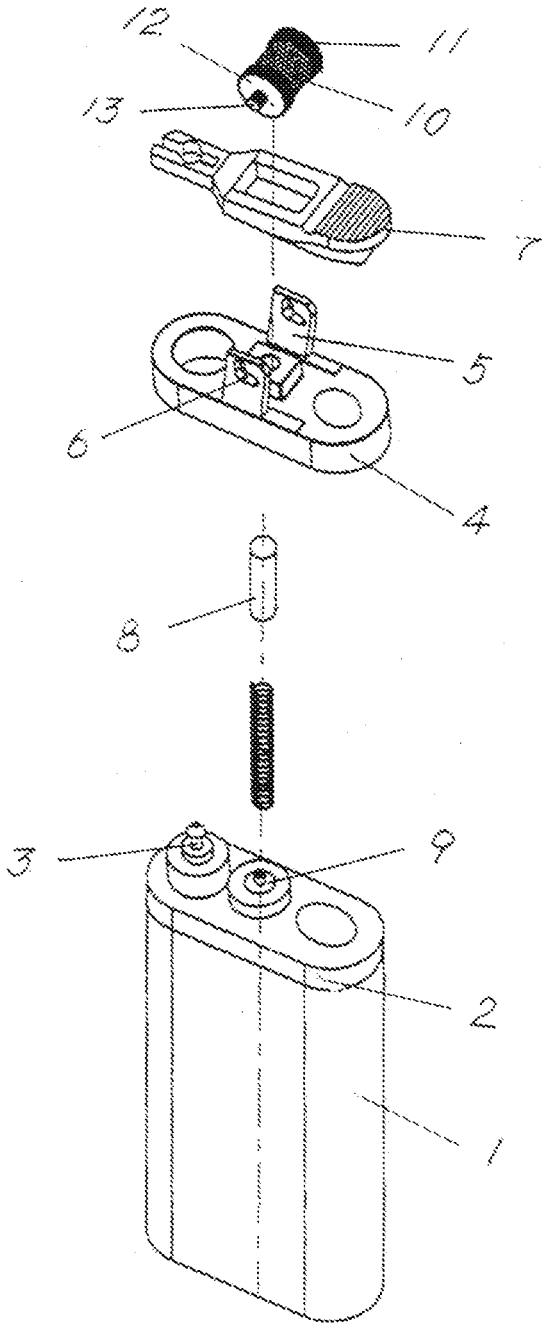
FIG. 1 is an exploded view of an embodiment of a gas lighter according to the present invention.

As shown in FIG. 1, a gas lighter of the present invention comprises a fuel reservoir 1 for containing combustible fuel and an inner frame 2 disposed on top of the fuel reservoir 1. A valve 3 is placed on the inner frame 2 for releasing the combustible fuel from the fuel reservoir 1. An outer frame 4 is mounted on top of the inner frame 2, and has two supports 5 separately extended upwards from opposite sides of the outer frame 4 and aligned with each other. Each of the supports 5 is provided with a L-shaped supporting hole 6 including a vertical section and a horizontal section, in which the vertical section is nearer to the valve than the horizontal section.

A lever 7 is sandwiched between the two supports 5, and is pivotable with respect to the outer frame 4 for actuating the valve 3 to release the fuel from the fuel reservoir 1.

A flint 8 is disposed between the two supports by virtue of, for example, a flint seat 9 provided on the inner frame 2, and extends upwards through the outer frame 4 and the lever 7. The flint 8 is aligned with the horizontal sections of the L-shaped supporting holes 6, and is biased from the vertical sections thereof.

Figure 2:
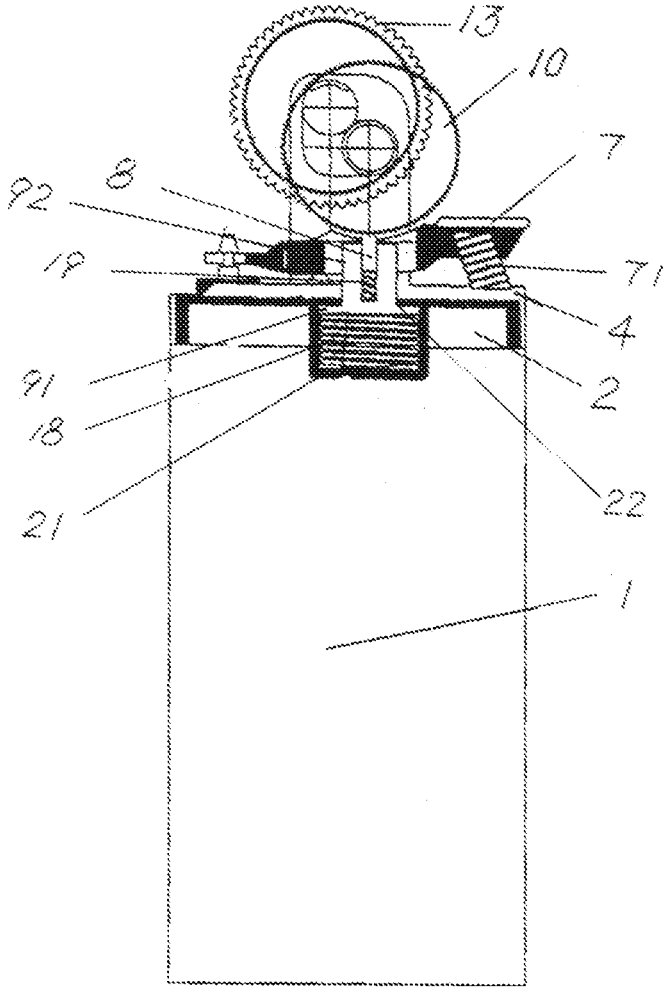
FIG. 2 is a schematic cross-sectional view of the gas lighter illustrating the movement of a friction wheel of the gas lighter.
Figure 3:
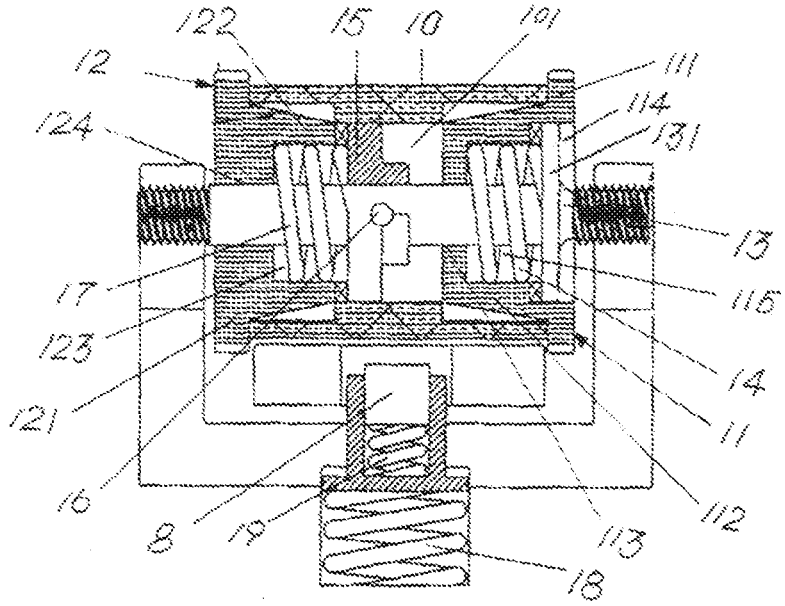
FIG. 3 is a cross-sectional view of part of the gas lighter illustrating that the friction wheel is separate from a flint.
Figure 4:
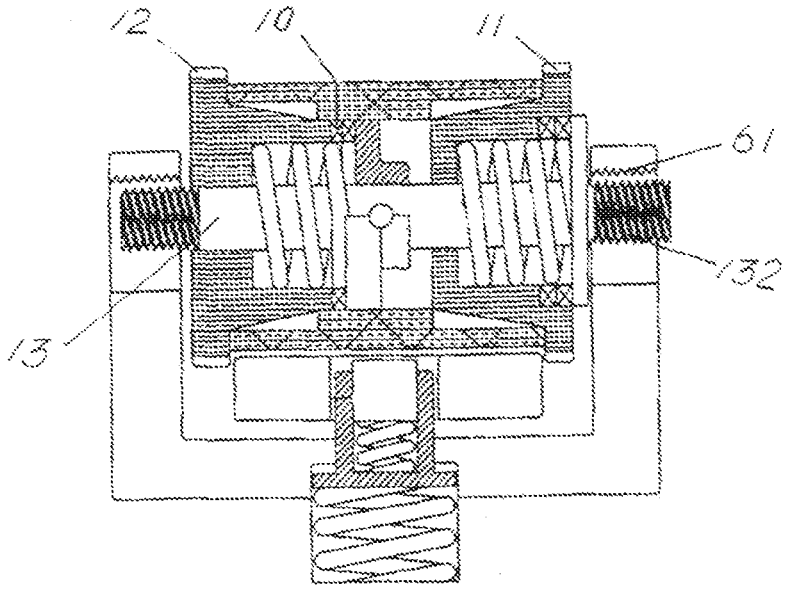
FIG. 4 is a cross-sectional view of part of the gas lighter illustrating that the friction wheel contacts the flint.

A friction wheel 10 is sandwiched between two side wheels 11 and 12 within the two supports, and is rotatably sleeved on a shaft 13 together with the two side wheels 11 and 12. Opposite ends of the shaft 13 are movably supported in the L-shaped supporting holes 6. As shown in FIGS. 2 and 3, when the shaft 13 is moved to the vertical sections of the supporting holes 6, the friction wheel 10 is separate from the flint 8. However, as shown in FIG. 4, when the shaft 13 is moved to the horizontal sections of the supporting holes 6, the friction wheel 10 approaches to the flint 8 and finally contacts the latter.

With reference to FIG. 2, a spring 71 is positioned between the outer frame 4 and an end of the lever 7 opposite to the valve 3, to enable to push the lever 7 upwards against the friction wheel 10. Thereby, the shaft 13 is always pressed into the vertical sections of the L-shaped supporting holes 6, and in turn the friction wheel 10 is displaced away from the flint 8.

As shown in FIG. 3, the friction wheel 10 comprises an inner bore 101 extending through the whole length thereof, to be sleeved on the shaft 13 and receive part of the side wheels 11 and 12 from its opposite ends.

The side wheel 11 includes a rim 111 adjoining one end of the friction wheel 10, a protrusion 112 extending from the rim 111 into the inner bore 101 of the friction wheel 10, a first axle aperture 113 formed at tip of the protrusion 112, a second axle aperture 114 formed at bottom of the rim 111 and a through hole 115 communicating the first and second apertures 113 and 114. The diameter of the first axle aperture 113 is slightly larger than that of the shaft 13, to enable to be rotatably mounted on the shaft 13. A flange 131 is formed on the shaft 13, the size of which is slightly smaller than that of the second axle aperture 113 to be movable back and forth in the latter. A compression spring 14 is mounted within the through hole 115 between the side wheel 11 and the flange 131, to press the rim 111 of the side wheel 11 against the end of the friction wheel 10.

The side wheel 12 includes a rim 121 adjoining the other end of the friction wheel 10, a protrusion 122 extending from the rim 121 into the inner bore 101, a first axle aperture 123 formed at tip of the protrusion 122, and a second axle aperture 124 formed at bottom of the rim 121. The second axle aperture 124 has a diameter slightly larger than that of the shaft 13 and communicates with the first axle aperture 123, to enable to be rotatably mounted on the shaft 13. A stopper 15 is mounted in the inner bore 101 in front of the protrusion 122 of the side wheel 12, and is fixed to the shaft 13 by virtue of a pin 16. A compression spring 17 is mounted within the first axle aperture 123 between the side wheel 12 and the stopper 15.

A screw thread 132 is formed at each end of the shaft 13, while a matching screw thread 61 is formed in a top part of the vertical section of each L-shaped supporting hole 6. When the shaft 13 is pressed into the vertical sections of the supporting holes 6, the screw thread 132 of the shaft 13 starts to engage with the matching screw thread 61 in the vertical sections of the supporting holes 6.

When the shaft 13 is rotated in the direction to generate sparks, the screw threads 132 would engage with the matching screw threads 61 more and more tightly. The flange 131 would be moved into the second axle aperture 114 of the side wheel 11, and in turn the compression spring 14 presses the protrusion 112 to enable the rim 111 press against the friction wheel 10 tightly. At the same time, the stopper 15 is moved towards the side wheel 12, and in turn the compression spring 17 presses the side wheel 12 against one of the support 5. Therefore, the friction wheel 10 is sandwiched tightly by the rims 111 and 121 and is difficult to be rotated. Thereby, the shaft 13, the friction wheel 10 and the two side wheels 11 and 12 could not be rotated.

As mentioned above, when the shaft 13 is in the vertical sections of the L-shaped supporting holes 6, the friction wheel 10 is separate from the flint 8. Furthermore, the friction wheel 10 could not be rotated. Thus, it is not possible to generate sparks by the friction wheel 10 and the flint 8.

The inner frame 2 includes a receiver 21 for receiving the flint seat 9, and a hole 22 for the flint seat 9 to extend out of the receiver 21. The flint seat 9 is provided with a flange 91 at a bottom thereof, and a spring 18 is located between the flange 91 and the receiver 21 and intends to push the flint seat 9 out of the receiver 21. The size of the flange 91 is larger than that of the hole 22, to prevent the flint seat 9 from getting rid of the receiver 21 through the hole 22. A recess 92 is formed at top of the flint seat 9 for receiving a spring 19 and the flint 8 consequently. The spring 19 intends to push the flint 8 upward towards the friction wheel 10. Therefore, when the friction wheel 10 approaches to the flint 8, the spring 19 could press the flint 8 against the friction wheel 10, to enable the flint 8 contact the friction wheel 10 tightly.

The operation of the gas lighter of the present invention is described as follows:

As shown in FIGS. 2 and 4, to enable to generate sparks, the friction wheel 10 should be first pressed downwards, which enables the screw threads 132 of the shaft 13 to disengage with the matching screw threads 61 in the vertical sections of the supporting holes 6. The compression spring 14 then pushes the flange 131 out of the second axle aperture 114 of the side wheel 11. The stopper 15 is then moved backwards together with the shaft 13. Thus, the friction wheel 10 is free to be rotated.

To generate sparks between the friction wheel 10 and the flint 8, the friction wheel 10 should be further brought to contact the flint 8. In this connection, the shaft 13 should be moved into the horizontal sections of the supporting holes 6, and then the friction wheel 10 could contact the flint 8. Subsequently, the friction wheel 10 is rotated to strike against the flint 8, and thereby sparks could be generated towards the valve 3. After rotating the friction wheel 10, the thumb of a user would press on the lever 7 consequently, and the valve 3 is in turn actuated by the lever 7 to release the fuel from the fuel reservoir 1. The sparks could finally ignite the fuel released from the fuel reservoir 1 to generate flames.

After the gas lighter is used, the lever 7 is released, and the valve 3 is closed consequently. At this time, the spring 71 pushes the lever 7 upwards to press against the friction wheel 10. Subsequently, the friction wheel 10 together with the shaft 13 is moved along the L-shaped supporting holes 6 to make the friction wheel 10 depart from the flint 8. Finally, the shaft 13 is pushed to the top of the vertical sections of L-shaped supporting holes 6 and make the screw threads 132 of the shaft 13 to engage with the matching screw threads 61 in the vertical sections.

As children would only rotate the friction wheel to operate common gas lighters, they would not know that the friction wheel in the gas lighters of the present invention could be rotated only after it is pressed downwards and backwards. If they rotate the friction wheel of the present invention directly, the friction wheel would be too tight to be rotated. Therefore, children are not able to operate the gas lighters of the present invention.

Even if children know how to operation the present gas lighters, they are not strong enough to press the friction wheel downwards and backwards, and at the same time rotate the friction wheel. Thus, they still could not operate the present gas lighters.

Although the description of the present invention is made with reference to the preferred embodiments, the present invention is not limited to these embodiments. Various modifications and changes can be made to the invention by those skilled in the art without departing from the spirit and scopes of the present invention.

What is claimed is:

1. A gas lighter with safety mechanism comprising:

an inner frame mounted on top of a fuel reservoir containing combustible fuel and provided with a valve for releasing the fuel contained in the fuel reservoir;

an outer frame mounted on top of the inner frame and having two supports separately extended upwards from opposite sides of the outer frame and aligned with each other, in which each of the supports is provided with a L-shaped supporting hole including a vertical section and a horizontal section, the vertical section extends upwards from one end of the horizontal section, which is nearer to the valve than an other end of the horizontal section, and the L-shaped supporting hole is oriented with respect to the inner frame so that the horizontal section is closest to the inner frame;

a lever sandwiched between the two supports and pivotable with respect to the outer frame to actuate the valve;

a flint disposed between the two supports, in which the flint is aligned with the horizontal sections of the L-shaped supporting holes and biased from the vertical sections thereof;

a friction wheel rotatably sleeved on a shaft between the two supports, in which opposite ends of the shaft are movably supported in the L-shaped supporting holes of the supports, the friction wheel is separate from the flint when the shaft is moved down the vertical sections of the L-shaped supporting holes, and the friction wheel contacts the flint to enable to generate sparks by rotating the friction wheel when the shaft is moved along the horizontal sections of the L-shaped supporting holes.

2. A gas lighter with safety mechanism comprising:

an inner frame mounted on top of a fuel reservoir containing combustible fuel and provided with a valve for releasing the fuel contained in the fuel reservoir;

an outer frame mounted on top of the inner frame and having two supports separately extended upwards from opposite sides of the outer frame and aligned with each other, in which each of the supports is provided with a L-shaped supporting hole including a vertical section and a horizontal section, and the vertical section is nearer to the valve than the horizontal section lever sandwiched between the two supports and pivotable with respect to the outer frame to actuate the valve;

a flint disposed between the two supports, in which the flint is aligned with the horizontal sections of the L-shaped supporting holes and biased from the vertical sections thereof;

a friction wheel rotatably sleeved on a shaft between the two supports, in which opposite ends of the shaft are movably supported in the L-shaped supporting holes of the supports, the friction wheel is separate from the flint when the shaft is moved to the vertical sections of the L-shaped supporting holes, while the friction wheel contacts the flint to enable to generate sparks by rotating the friction wheel when the shaft is moved to the horizontal sections of the L-shaped supporting holes, wherein a first spring is mounted between an end of the lever opposite to the valve and the outer frame, which always pushes the lever upwards against the friction wheel and in turn always pushes the shaft to the vertical sections of the L-shaped supporting holes.

3. The gas lighter with safety mechanism according to claim 2, wherein a screw thread is formed at each end of the shaft and a matching screw thread is formed at a top part of the vertical section of each L-shaped supporting hole, the screw thread and matching screw thread engage with each other when the opposite ends of the shaft are pushed upwards against the top of the vertical sections.

4. The gas lighter with safety mechanism according to claim 3, wherein the friction wheel comprises an inner bore extending through the whole length thereof, and a first and second side wheels are provided to sandwich the friction wheel, wherein the first side wheel includes a first rim adjoining one end of the friction wheel, a first protrusion extending from the first rim into the inner bore, a first axle aperture formed at tip of the first protrusion, a second axle aperture formed at bottom of the first rim and a through hole communicating the first and second axle apertures, in which the diameter of the first axle aperture is slightly larger than that of the shaft to enable to be rotatably mounted on the latter;

the second side wheel includes a second rim adjoining the other end of the friction wheel, a second protrusion extending from the second rim into the inner bore, a third axle aperture formed at tip of the second protrusion, and a fourth axle aperture formed at bottom of the second rim, in which the fourth axle aperture has a diameter slightly larger than that of the shaft and communicates with the third axle aperture;

wherein the gas lighter further comprises:

a first flange formed on the shaft the size of which is slightly smaller than that of the second axle aperture to be movable back and forth in the latter;

a first compression spring mounted within the through hole between the first side wheel and the first flange to press the first rim against the end of the friction wheel;

a stopper mounted in the inner bore in front of the second protrusion and fixed to the shaft; and a second compression spring mounted within the third axle aperture between the second side wheel and the stopper.

5. The gas lighter with safety mechanism according to claim 4, wherein a flint seat is provided to receive the flint, in which the flint seat is received in a receiver of the inner frame and extends out of the receiver through a hole; a second spring is located between the second flange and the receiver intending to push the flint seat out of the receiver; the flint seat is provided with a second flange at a bottom thereof the size of which is larger than that of the hole to prevent the flint seat from getting rid of the receiver through the hole, and a recess at top of the flint seat for receiving a third spring and the flint consequently; the third spring intends to push the flint upward towards the friction wheel.

6. A gas lighter with safety mechanism comprising:

an inner frame mounted on top of a fuel reservoir containing combustible fuel and provided with a valve for releasing the fuel contained in the fuel reservoir;

an outer frame mounted on top of the inner frame and having two supports separately extended upwards from opposite sides of the outer frame and aligned with each other, in which each of the supports is provided with a L-shaped supporting hole including a vertical section and a horizontal section, and the vertical section is nearer to the valve than the horizontal section lever sandwiched between the two supports and pivotable with respect to the outer frame to actuate the valve;

a flint disposed between the two supports, in which the flint is aligned with the horizontal sections of the L-shaped supporting holes and biased from the vertical sections thereof:

a friction wheel rotatably sleeved on a shaft between the two supports, in which opposite ends of the shaft are movably supported in the L-shaped supporting holes of the supports, the friction wheel is separate from the flint when the shaft is moved to the vertical sections of the L-shaped supporting holes, while the friction wheel contacts the flint to enable to generate sparks by rotating the friction wheel when the shaft is moved to the horizontal sections of the L-shaped supporting holes, wherein a screw thread is formed at each end of the shaft and a matching screw thread is formed at a top part of the vertical section of each L-shaped supporting hole, the screw thread and matching screw thread engage with each other when the opposite ends of the shaft are pushed upwards against the top of the vertical sections.

7. The gas lighter with safety mechanism according to claim 6, wherein the friction wheel comprises an inner bore extending through the whole length thereof, and a first and second side wheels are provided to sandwich the friction wheel, wherein the first side wheel includes a first rim adjoining one end of the friction wheel, a first protrusion extending from the first rim into the inner bore, a first axle aperture formed at tip of the first protrusion, a second axle aperture formed at bottom of the first rim and a through hole communicating the first and second axle apertures, in which the diameter of the first axle aperture is slightly larger than that of the shaft to enable to be rotatably mounted on the latter;

the second side wheel includes a second rim adjoining the other end of the friction wheel, a second protrusion extending from the second rim into the inner bore, a third axle aperture formed at tip of the second protrusion, and a fourth axle aperture formed at bottom of the second rim, in which the fourth axle aperture has a diameter slightly larger than that of the shaft and communicates with the third axle aperture;

wherein the gas lighter further comprises:

a first flange formed on the shaft the size of which is slightly smaller than that of the second axle aperture to be movable back and forth in the latter;

a first compression spring mounted within the through hole between the first side wheel and the first flange to press the first rim against the end of the friction wheel;

a stopper mounted in the inner bore in front of the second protrusion and fixed to the shaft; and a second compression spring mounted within the third axle aperture between the second side wheel and the stopper.

8. The gas lighter with safety mechanism according to claim 7, wherein a flint seat is provided to receive the flint, in which the flint seat is received in a receiver of the inner frame and extends out of the receiver through a hole; a second spring is located between the second flange and the receiver intending to push the flint seat out of the receiver; the flint seat is provided with a second flange at a bottom thereof the size of which is larger than that of the hole to prevent the flint seat from getting rid of the receiver through the hole, and a recess at top of the flint seat for receiving a third spring and the flint consequently; the third spring intends to push the flint upward towards the friction wheel.

* * * * *